US005672127A

United States Patent [19]

Danz

[11] Patent Number: 5,672,127

[45] Date of Patent: Sep. 30, 1997

[54] BASEBALL GLOVE TRAINING DEVICE

[76] Inventor: Lisa M. Danz, 3193 Wayside Plz. #34, Walnut Creek, Calif. 94596

[21] Appl. No.: 368,295

[22] Filed: Jan. 3, 1995

[51] Int. Cl.[6] ..... A63B 43/02

[52] U.S. Cl. ..... 473/458

[58] Field of Search ..... 273/25, 58 C; 128/78, 85 R, 134, 876, 870; 2/452; 662/20; 482/123, 129

[56] References Cited

U.S. PATENT DOCUMENTS

| | | | |
|---|---|---|---|
| 3,620,211 | 11/1971 | Goodell | 128/78 |
| 3,889,668 | 6/1975 | Ochs | 128/134 |
| 4,205,670 | 6/1980 | Owens | 128/134 |
| 4,299,211 | 11/1981 | Doynow | 128/89 R |
| 4,592,549 | 6/1986 | Ryan | 273/58 C |
| 4,841,961 | 6/1989 | Burlage | 128/876 |
| 5,481,763 | 1/1996 | Brostrom | 2/452 |

*Primary Examiner*—Theatrice Brown
*Attorney, Agent, or Firm*—Harris Zimmerman

[57] ABSTRACT

A device for training or breaking in a baseball glove or mitt includes a pair of longitudinal webs or straps that are disposed in spaced apart relationship, and a plurality of lateral webs or straps secured to the longitudinal straps in parallel, spaced apart relationship. The lateral straps are disposed to be secured about the baseball mitt to compress the mitt about a baseball disposed within the pocket of the mitt. An upper lateral strap is disposed to encircle the upper end portion of the mitt, a medial lateral strap is disposed to encircle the medial portion of the mitt, and a lower lateral strap is disposed to encircle the heel portion of the mitt. The lateral straps are formed of a resilient elastic material, and include adjustable fasteners such as hook and loop fabric patches at opposed ends. The fasteners permit the lateral straps to be secured about mitts of various sizes, and the elastic tension of the straps applies a constant constricting force to the mitt. The longitudinal straps may be formed of a woven web material, such as cotton, Nylon, or the like, and are provided in part to maintain the spacing and assembly of the lateral straps. The longitudinal straps also include adjustable fasteners such as hook and loop fabric patches at opposed ends, so that the like opposed ends of the longitudinal straps may be joined to form loops. These loops retain the mitt within the encircling lateral straps, and also serve as convenient handles for carrying, transporting, and hanging the mitt from a hook or other support.

9 Claims, 3 Drawing Sheets

BASEBALL GLOVE TRAINING DEVICE

BACKGROUND OF THE INVENTION

The present invention relates to baseball gloves, and more particularly to a device for properly forming and breaking in a baseball glove.

In recent years most of the major sports and athletic activities that are followed by the general public have been transformed by advances in materials research and development. Plastics and polymers, fiber reinforcement and composite materials, aerodynamic designs, computer simulations of motion and force relationships in athletic movements, innovative textiles, and the like have all contributed to a renaissance in sports. In some realms, such as skiing or tennis, the result has been a complete transformation of the sport. Although many individuals welcome these changes or at least accept them as the inevitable result of the technological imperative, others regret the loss of tradition and style. Moreover, the rapid modernization of a sport prevents accurate comparisons of heroes of yesteryear with current champions.

One sport that has remained relatively untainted by new technology is baseball. Baseball bats are still made of wood (in the major leagues, at least), the gloves are made of leather, and the baseball itself is wound and covered in the same manner as a century ago. Many baseball fans revere the traditions of baseball, and resist the slightest change in baseball paraphernalia, customs, or rules of the game.

Every baseball player on the field uses a glove or mitt, and each player takes a personal interest in forming or training the glove (the "breaking in" process) so that is has the desired pocket configuration, conforms to the hand of the player, and is sufficiently flexible to retain a ball when caught and release the ball for removal and throwing. This process has generally involved placing a baseball in the pocket of the mitt, and compressing the mitt about the ball to achieve the proper configuration, removing the ball, and working the leather by hand. Some players, especially younger players, may carry out this process with an intensity that approaches a fetish. For example, they may compress the mitt by placing it under their mattress and sleeping on it nightly to achieve the desired effect.

Older players, or those professionals who cannot devote the time to breaking in many mitts in a single playing season, may delegate the breaking in task to others, such as team equipment managers and the like. There is no device in the prior art for facilitating or hastening the breaking in process.

SUMMARY OF THE INVENTION

The present invention generally comprises a device for training or breaking in a baseball glove or mitt. The device includes a pair of longitudinal webs or straps that are disposed in spaced apart relationship. A plurality of lateral webs or straps is secured to the longitudinal straps in parallel, spaced apart relationship. The lateral straps are disposed to be secured about the baseball mitt to compress the mitt about a baseball disposed within the pocket of the mitt. An upper lateral strap is disposed to encircle the upper end portion of the mitt, a medial lateral strap is disposed to encircle the remedial portion of the mitt, and a lower lateral strap is disposed to encircle the heel portion of the mitt.

The lateral straps are formed of a resilient elastic material, and include adjustable fasteners such as hook and loop fabric patches at opposed ends. The fasteners permit the lateral straps to be secured about mitts of various sizes, and the elastic tension of the straps applies a constant constricting force to the mitt. The longitudinal straps may be formed of a woven web material, such as cotton, Nylon, or the like, and are provided in part to maintain the spacing and assembly of the lateral straps. The longitudinal straps also include adjustable fasteners such as hook and loop fabric patches at opposed ends, so that the like opposed ends of the longitudinal straps may be joined to form loops. These loops retain the mitt within the encircling lateral straps, and also serve as convenient handles for carrying, transporting, and hanging the mitt from a hook or other support.

DESCRIPTION OF THE PREFERRED EMBODIMENT

Figure 1:
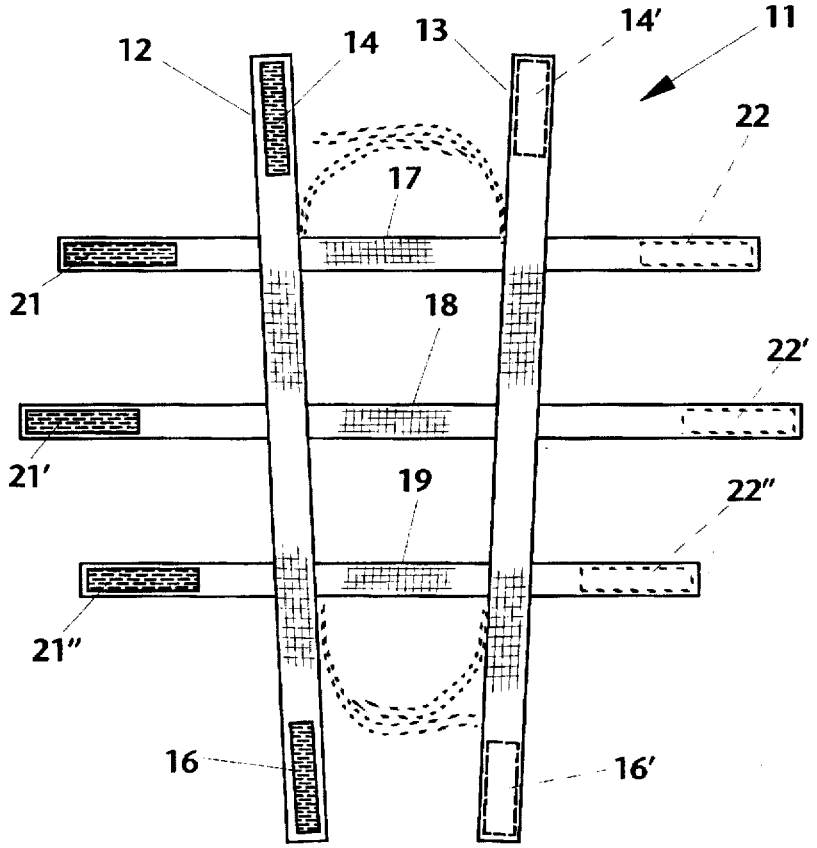
FIG. 1 is a plan view of the baseball mitt training device of the present invention.
Figure 2:
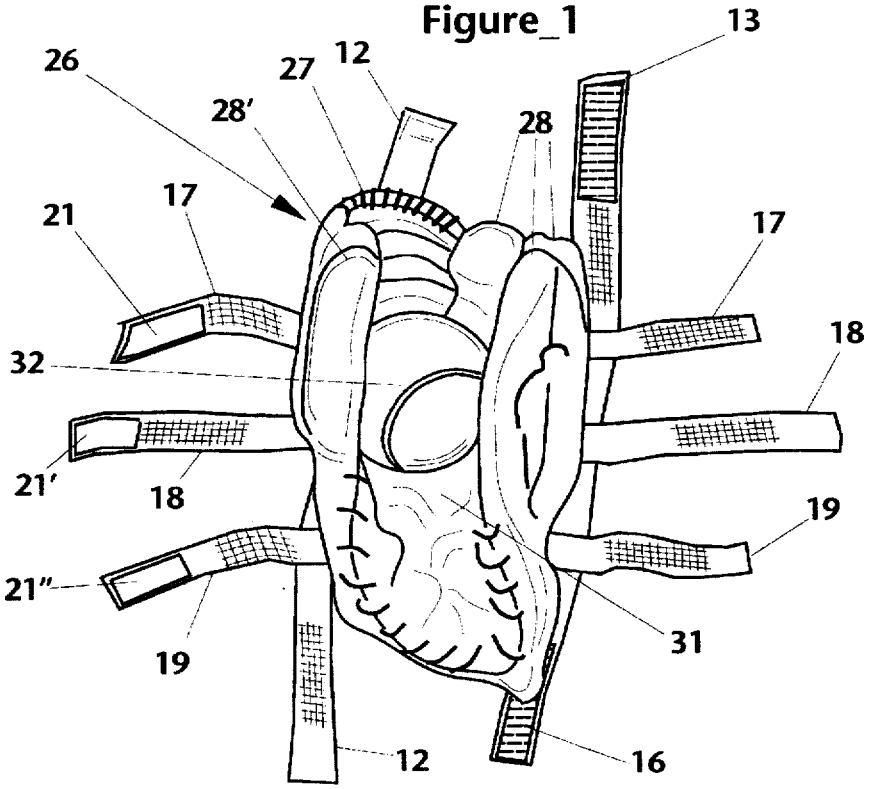
FIG. 2 is a top view showing the baseball mitt training device fully open with a typical baseball mitt disposed therein.
Figure 3:
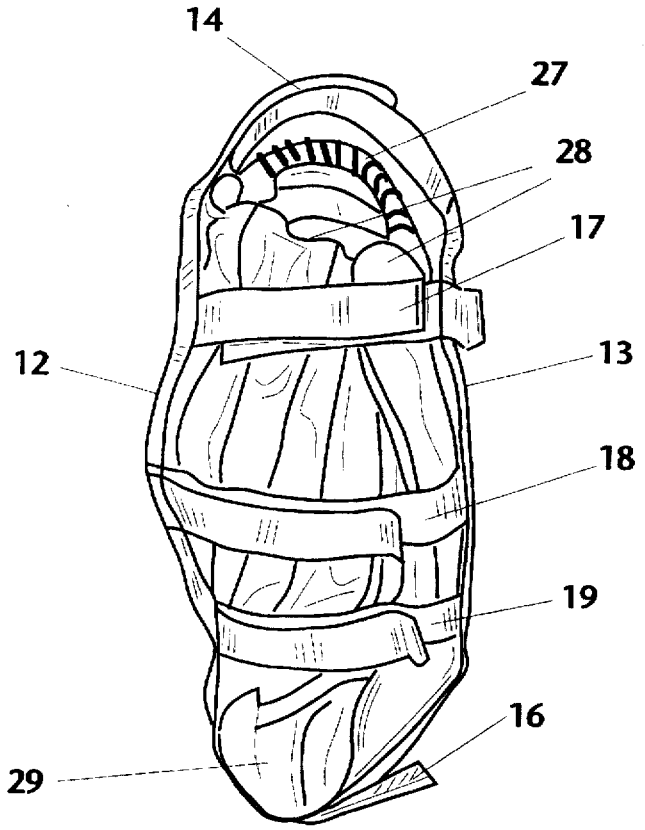
FIG. 3 is a view as in FIG. 2, showing the baseball mitt training device fully closed to encircle a typical baseball mitt therein.

The present invention generally comprises a device for training or breaking in a baseball glove or mitt, so that the pocket of the mitt generally conforms to a baseball, the shape of the mitt conforms to the hand of the player, and the leather or other material that forms the mitt is sufficiently flexible to retain a baseball in the pocket and release the ball when the player chooses to do so. With regard to FIGS. 1 and 2 in particular, the training device 11 includes a pair of longitudinal straps 12 and 13 formed of strong, flexible material such as webbing, belting or the like formed of cotton, Nylon, or any similar woven or non-woven material that is lightweight and strong material. The straps 12 and 13 are spaced apart laterally, with lower ends converging at a slight angle. Strap 12 includes fabric fastener patches 14 and 16 at opposed ends, and strap 13 includes fabric fastener patches 14' and 16' on the obverse surfaces of its opposed ends. The opposed fabric fastener patches 14 and 14', 16 and 16' are disposed to be brought together in an overlapping loop, as shown in broken line in FIG. 1, to form the longitudinal straps in an endless loop.

The device 11 further provides a plurality of lateral straps, including upper strap 17, medial strap 18, and lower strap 19, extending generally parallel each to the other and intersecting the longitudinal straps 12 and 13. The intersections of the longitudinal and lateral straps are each joined by seams, rivets, adhesive, or the like to unite the two materials as they cross. The lateral straps 17–19 are formed of a resilient elastic webbing. Straps 17–19 include fabric fastener patches 21, 21', and 21" at respective adjacent ends and on like upper surfaces thereof. The straps 17–19 further include fabric fastener patches 22.22', and 22" on the obverse surfaces of respective opposed ends. The opposed fabric fastener patches 21, 21', and 21" are disposed to be brought together with respective ends 22, 22', and 22" in adjustably overlapping loops, as shown in FIG. 3–6.

The device 11 is adapted to be employed with a typical baseball fielding glove or mitt 26, as shown in FIGS. 2–6. The mitt includes a web 27, a plurality of fingers 28, a thumb 28', and a web extending between the thumb 28' and the adjacent finger 28. The pocket 31 is defined below the web 27 and between the thumb and fingers, and the heel 29 comprises the lower end of the mitt. The lateral straps 17–19 are disposed to encircle the mitt with a ball 32 disposed in the pocket 31. With regard to FIGS. 3 and 4, lateral strap 17 is disposed to extend about the upper ends of the fingers and webbing of the mitt 26, the fabric fastener patches 21 and 22 overlapping to form a loop encircling the upper portion of the mitt. The ends of the strap may be pulled to place the strap 17 under elastic tension before the fastener patches 21 and 22 are joined, so that the upper portion of the mitt is constricted and compressed by the restoring force of the strap.

Likewise, the strap 18 is secured under elastic tension about the medial portion of the mitt 26, including the pocket 31 with the ball 32 therein, as well as the medial portions of the fingers and thumb of the mitt. The strap 19 is also secured under elastic tension about the lower, heel end of the mitt. The lateral straps collapse the mitt about the ball 32, so that the leather or other material of the mitt is trained to form the desired pocket configuration. It is noted that the medial strap 18 is slightly longer than the straps 17 or 19, due primarily to the fact that the strap 18 must encircle the greater circumference defined by the pocket and ball of the mitt. The elastic tension of the lateral straps applies constant constricting force to the mitt, even as the mitt material bends and yields under the constricting force, so that mitt training is carded out as quickly as possible.

Figure 4:
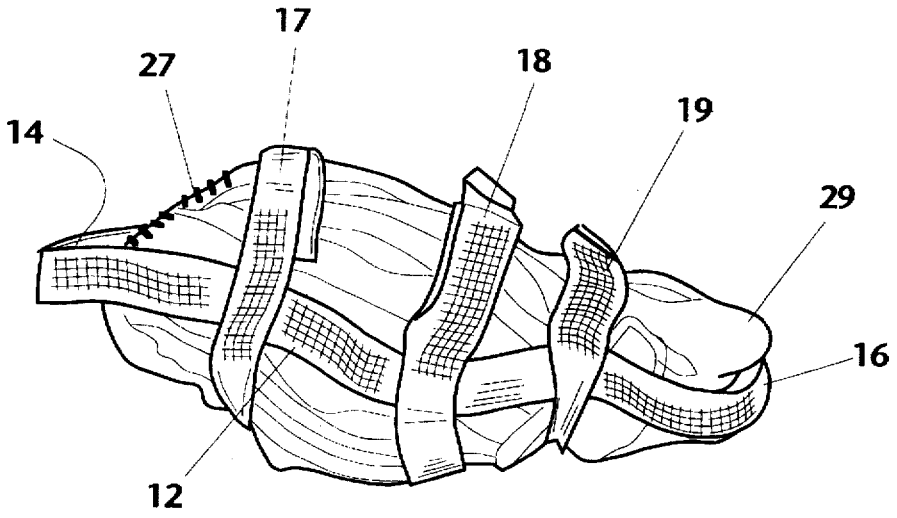
FIG. 4 is a side view of the baseball mitt training device fully closed to encircle a typical baseball mitt.
Figure 5:
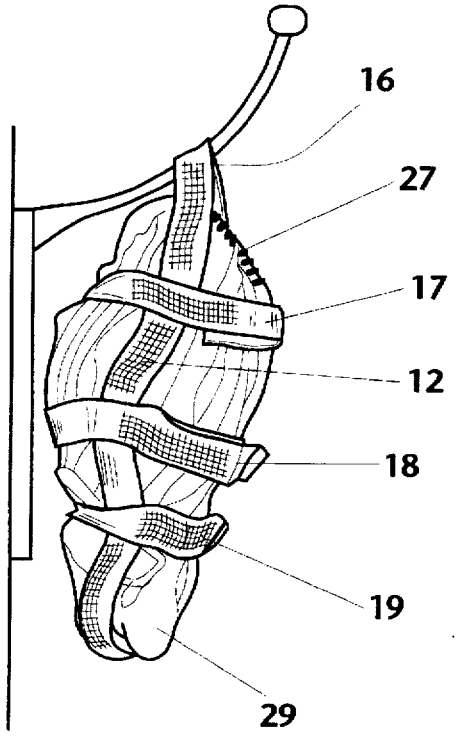
FIG. 5 is a side view of a baseball mitt secured in the training device and suspended from a hook for storage.
Figure 6:
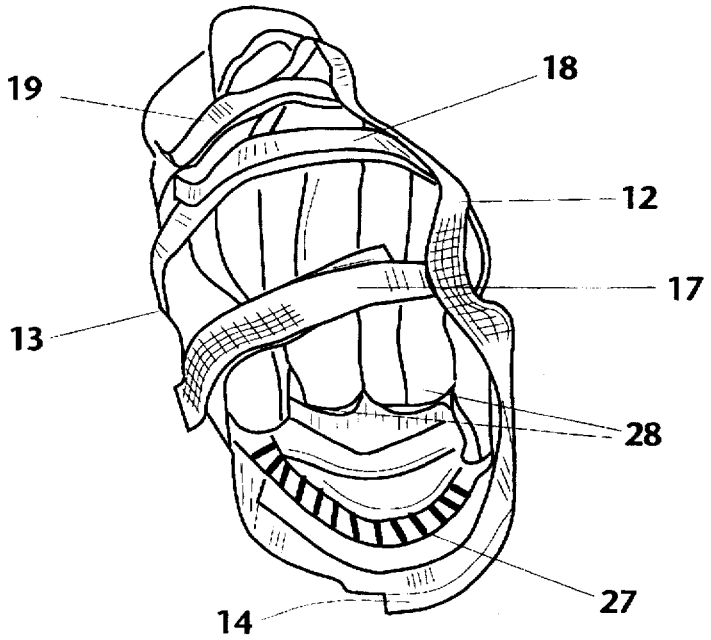
FIG. 6 is an end view of a baseball mitt secured in the training device.

The fabric fastener patches 14—14' and 16—16' are also joined about the upper and lower ends of the mitt 26 to maintain the positioning of the mitt 26 longitudinally within the assembly. The longitudinal straps served to maintain the spacing and assembly of the lateral straps, as shown in FIGS. 4–6. The lateral straps thus may be placed accurately with respect to the mitt 26 to provide the optimal compression and training for the mitt.

The combination of the elastic material of the lateral straps and the fabric fastener patches permits one device 11 to be adapted for use with a wide variety of baseball mitts or gloves and a wide range of sizes. The straps are sufficient in width to provide space for athletic team colors, logos, and emblems, as well as other advertising indicia.

The device 11 is also useful for transporting and storing the mitt 26. The loop formed by the fastener patches 14 and 14' may be used as a handle for manually grasping and carrying the mitt, while the pocket configuration is trained and maintained. The same loop may be used to suspend the mitt 26 from any hook, such as a coat hook, locker hook, or the like, as shown in FIG. 5.

The foregoing description of the preferred embodiment of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

I claim:

1. An apparatus for training a sports glove to assume a desired shape, including:

first means for releasably circumscribing and compressing an upper portion of the sports glove;

second means for releasably circumscribing and compressing a medial portion of the sports glove;

third means for releasably circumscribing and compressing a lower portion of the sports glove;

longitudinal means for joining said first, second, and third means in spaced apart relationship;

said first means including an upper lateral strap formed of resilient elastic material and means for joining opposed ends of said upper lateral strap in length adjustable fashion to form a closed loop about said upper portion of the sports glove;

said second means including a medial lateral strap formed of resilient elastic material and means for joining opposed ends of said medial lateral strap in length adjustable fashion to form a closed loop about said medial portion of the sports glove;

said third means including a lower lateral strap formed of resilient elastic material and means for joining opposed ends of said lower lateral strap in length adjustable fashion to form a closed loop about said lower portion of the sports glove;

said longitudinal means including a pair of longitudinal straps extending in spaced apart relationship and intersecting said first, second, and third lateral straps, and means for joining said longitudinal straps and said lateral straps at each intersection therebetween; and, fastener means joined to like tipper and lower ends of said longitudinal straps to releasably join said like upper and lower ends in length adjustable fashion in closed upper and lower end loops.

2. The apparatus of claim 1, wherein said longitudinal straps are formed of a non-elastic web material.

3. The apparatus of claim 2, wherein said longitudinal straps converge at small angle toward said like lower ends of said longitudinal straps.

4. The apparatus of claim 1, wherein said first, second, and third lateral straps are disposed in generally parallel relationship.

5. The apparatus of claim 1, wherein said second lateral strap is greater in length than said first and third lateral straps.

6. An apparatus for training a sports glove having an upper portion, a medial portion, and a lower portion to assume a desired shape, including:

first means for releasably circumscribing and compressing the upper portion of the sports glove;

second means for releasably circumscribing and compressing the medial portion of the sports glove;

third means for releasably circumscribing and compressing the lower portion of the sports glove;

longitudinal means for joining said first, second, and third means in spaced apart relationship;

wherein said longitudinal means includes a pair of longitudinal straps extending in spaced apart relationship between said first, second, and third means, said pair of longitudinal straps including like upper ends extending contiguously in spaced apart relationship and like lower ends extending contiguously in spaced apart relationship.

7. The apparatus of claim 6, wherein said longitudinal straps converge at a small angle toward like lower ends of said longitudinal straps.

8. The apparatus of claim 7, further including fastener means joined to said like lower ends of said longitudinal straps to releasably join said like lower ends in length adjustable fashion in a closed lower end loop.

9. The apparatus of claim 8, further including fastener means joined to like upper ends of said longitudinal straps to releasably join said like upper ends in length adjustable fashion in a closed upper end loop.

* * * * *